United States Patent [19]

Pitts et al.

[11] Patent Number: 5,037,702

[45] Date of Patent: Aug. 6, 1991

[54] ERASABLY, MARKABLE ARTICLES AND METHODS OF MAKING SUCH ARTICLES

[75] Inventors: Warren R. Pitts, Needham; Peter West, Wellesley, both of Mass.

[73] Assignee: Dennison Manufacturing Company, Framingham, Mass.

[21] Appl. No.: 360,962

[22] Filed: Jun. 2, 1989

[51] Int. Cl.[5] ..... B32B 27/08; B32B 27/10; B05D 3/06

[52] U.S. Cl. ..... 428/423.7; 427/39; 427/40; 427/41; 427/54.1; 427/372.2; 428/423.7; 428/424.8; 428/425.1; 428/483; 428/514

[58] Field of Search ..... 428/514, 423.7, 424.8, 428/425.1, 483; 427/39, 40, 41, 54.1, 372.2

[56] References Cited

U.S. PATENT DOCUMENTS 4,393,103 7/1983 Louden ..... 428/514
4,603,079 7/1986 Nishizaki et al. ..... 428/424.8

*Primary Examiner*—William J. Van Balen
*Attorney, Agent, or Firm*—Arthur B. Moore

[57] ABSTRACT

An erasably markable article formed of a coated substrate that is markable with dry wipe inks without causing permanent discernible distortion of the substrate. The surface after marking is substantially fully erasable. The surface is provided by a smooth coating of cured lacquer preferably a radiation cured lacquer, for example, electron beam radiation cured urethane acrylate. The substrate may be flexible, for example, a biaxially oriented polypropylene multilayer film having a closed cell foam-like core wherein the substrate exhibits electrostatic cling properties. The substrate may also be adhesive coated paper or may be relatively inflexible pressboard.

26 Claims, No Drawings

ERASABLY, MARKABLE ARTICLES AND METHODS OF MAKING SUCH ARTICLES

BACKGROUND OF THE INVENTION

The present invention relates to articles of manufacture having one or more erasably markable surfaces. In one preferred embodiment, such articles are flexible and removably adhered to a surface via applied removable pressure sensitive adhesive, many forms of which are well known in the art of pressure sensitive adhesive technology. In another preferred embodiment, such flexible articles are statically chargeable and capable of clinging to a relatively smooth, flat or curved surface such as a wall.

Dry erasable marking systems are known in the art, one of the earliest of which consists of a blackboard, chalk and a dry eraser. Other dry erasable marking systems include felt tip marking instruments which contain specially produced inks which will satisfactorily mark smooth, hard, rigid, plastic surfaced boards and which can be erased from the plastic surface after the ink has dried using a dry eraser, such as a cloth or paper tissue. In addition, erasably markable flexible articles are known in the art, some of which are capable of clinging to a surface such as a wall. However, these flexible articles suffer from one or more of the following disadvantages: Deformation by the chemical materials used to mark the surface; surface deterioration after repeated marking and erasing, accompanied by either loss of dry erase ink ability to wet out the surface or development of ghost images; and inability to be repositioned at will over extensive time periods. For instance, Static Images TM dry erasable electrostatic cling polypropylene film is uncoated. This material is deformed by inks used in commercially available dry erase markers, and repeated image/erase cycles mechanically abrade the surface making the erase step progressively more difficult.

Other polypropylene film surfaced erasably markable articles that are commercially available include Sanford Expo® Dry Erase Surface and Rubbermaid Con-Tact® White Board Erasable Marking Surface. These are both backed by permanent bonding pressure sensitive adhesive. Another polypropylene surfaced erasably markable article is available as Re-Mark-A-Chart® erasable flip-charts manufactured by Ghent, Inc. The erasably markable character of these surfaces deteriorates gradually with repeated application and erasure of dry wipe inks.

SUMMARY OF THE INVENTION

The articles of the present invention consist of substrates wherein at least one surface of the substrate is markable without permanent discernible distortion of the substrate, said surface after marking being substantially fully erasable. Surprisingly, said surface after marking is substantially fully erasable with only one stroke using a conventional dry wipe felt or foam eraser and normal manual effort. The erasable markable surface is provided by a smooth coating of a cured lacquer that is abrasion resistant and essentially impervious to chemical ingredients in commonly available dry erase markers. In accordance with one method of the present invention, erasably markable articles are provided by coating one or more surfaces of a flexible substrate with a curable lacquer and subsequent curing of the coating.

DETAILED DESCRIPTION

A variety of erasably markable articles are provided by following the teachings of the present invention. Preferred substrates for use in the practice of the present invention include flexible substrates such as paper and plastic film and relatively inflexible substrates such as cardboard and laminated pressboard.

A wide variety of paper substrates may be used to produce erasably markable articles in accordance with the teachings set forth herein. In one embodiment, a #60 coated pressure sensitive label facestock is provided with a coating of radiation cured urethane acrylate lacquer to produce an erasably markable article. In another embodiment of the present invention, an erasably markable article is produced by providing a cured lacquer coating on the front surface of Dennison STICK ON NOTES that utilize a removable adhesive on the back surface. Wire bound, cardboard notebook covers may also be surfaced with cured lacquer to provide erasably markable articles in accordance with the present invention. Other suitable paper substrates will be readily apparent to those skilled in the art.

Suitable film substrates for use in the practice of the present invention include polyester and polypropylene films. One preferred film substrate is a statically chargable, strong, biaxially oriented polypropylene multilayer film with a proprietary core that resembles a closed cell foam structure. When electrostatically charged, this preferred film clings to surfaces. This preferred film is available commercially from Mobil Chemical Company under the tradename OPPalyte® TW. Such film itself is erasably markable to a limited degree. However, when the surface of the OPPalyte® TW film, which has not been coated in accordance with the present invention, is marked with commercially available dry erase inks and the inks are left resident on the film for varying periods of time before erasing the markings, component(s) of the inks distort the film within a few hours and eventually stain the surface of the film. The distortion can take the form of an outward dimpling of the surface in the area wherein the dry erase ink was marked. The dimple amplitude is typically about 0.01 inches after 24 hrs. The coating of the present invention eliminates this prior art distortion problem.

The preferred radiation cured lacquer coatings used in the present invention provide a surface which may be marked satisfactorily by commercially available dry wipe erasable marking inks, (e.g., Sandford "Expo", Dixon "White System", Schwan "Stabilo"), and dry erased using a dry wipe eraser, paper tissue, cloth or some other appropriate material. For satisfactory performance, the lacquer coating must be crosslinked to an extent that it avoids significant attack by chemicals in the marking material, thus eliminating or greatly minimizing permanent staining of the erasably markable article and/or distortion of the underlying substrate. Cured lacquers for use in the present invention must also be highly resistant to abrasive wear in order to withstand repetitive marking and erasing. The coating should be smooth to minimize friction forces during marking and erasing.

In addition, provided the substrate to be coated possesses heat resistance, the lacquer coatings employed in this invention may be heat curable chemical systems. For instance, alkyd, urea formaldehyde, melamine and similar high crosslink density resins could be employed on paper substrate. Greater versatility is, however, achieved using radiation curable lacquers. Thermal sensitive stocks can be coated and cured by electron beam (EB) and/or ultraviolet (UV) radiation. The EB radiation procedure causes the least elevation in substrate temperature and is definitely preferred when coating OPPalyt® TM.

In order to have dry erasable ink markers dispense smoothly on the erasably markable articles without any tendency to bead, it is preferable that the surface tension of the lacquer coated surface being marked should be higher than that of the material used to mark the surface. It is recognized in the art that the greater the difference in surface tension, the better the ink will wet out the erasably markable surface. Experience gained with commercially available dry erase markers indicates that the minimum required surface tension of the cured coating depends mainly on the solvent(s) and/or surface active agents used in the dry erase marker. If the bulk solvent employed is denatured alcohol then the surface tension at 22° C. of the cured coating must be about 22 dyne/cm or greater. On the other hand, if methyl isobutyl ketone or ethyl acetate is the dominant solvent, the cured coating must exhibit a minimum surface tension of about 25 dyne/cm at 22° C., otherwise the dry erasable ink will bead up on the surface giving a severely deformed image. All commercially available dry erase markers tested in this invention satisfactorily imaged the cured coatings described in this invention provided the coatings exhibited a surface tension at 22° C. of about 25 dyne/cm or greater.

Caution is required in the manufacturing of items disclosed in this invention, most particularly in terms of inadvertent presence of silicones that can dramatically lower the surface tension of the cured coated substrate. The handling of pressure sensitive label stock with its associated silicone release sheet is always a potential source of deleterious silicone on the cured coated surface. Silicone contaminant on the surface can in the some instances be removed by wiping off with a solvent bearing cloth.

Innumerable radiation curable formulations could be used as coatings in the invention described herein, including acrylate based monomer/oligomer blends. Examples of suitable acrylate functionalized polymers include epoxy acrylates and, more preferably, urethane acrylate lacquers that provide exceptional flexibility and abrasion resistance. A preferred urethane acrylate lacquer formulation for use in the present invention is available commercially from W.R. Grace & Company, Photopolymer Systems under the name Radiation Curable Lacquer OPL-6E. Commercially available dry erasable ink formulations tested in this invention satisfaotorily marked the dry erase surface without disturbing the structure of this cured urethane acrylate lacquer, even on repeated marking/erase use.

Urethane acrylate lacquer coatings for the practice of the present invention may be cured by EB and/or UV irradiation. The UV curing system must employ lamps of appropriate spectral output, suitable reflector shape and web speeds to afford the required cure. Determination of the parameters of curing is within the skill in the art. The lacquer can be EB cured with or without a photoinitiator present. Both EB and UV curing methods utilize solventless chemistries which permit preparation of a wide variety of erasably markable articles.

In addition to dry erasably markable articles, the present invention also provides wet erasably markable articles. For instance, when an erasably markable surface is provided by a radiation cured urethane acrylate lacquer as taught herein, a permanent ink marker, such as Dennison Carter's MARKS-A-LOT®, can be erased from the surface by overwriting the dried "permanent" mark with a dry erase marker containing ethyl alcohol as a solvent or erasing with an eraser, or other suitable material, containing ethyl alcohol.

Permanent inks adhere to a substrate by design and usually contain a film former to promote adhesion and durability. On the other hand, dry erase inks which do not adhere to substrates by design usually contain not just a film former to carry colorant but also additives that are incompatible with the film former thus promoting poor adhesion to substrates.

A dry erasable article in accordance with the present invention was formed by providing at least one surface of an OPPalyte® TW film with a radiation cured coating of W.R. Grace OPL-6E urethane acrylate lacquer. Such articles retained the ability to cling to a surface such as a wall. In fact, if desired, the film may be coated on both surfaces without losing the cling property. Thus, an important aspect of the present invention is that the cured coatings employed herein have the additional property that they do not interfere with the inherent electrostatic property of the OPPalyte® TW film.

The capacitance of the polypropylene sheet is a function of the geometry of the dielectric material used. Large sheets of statically charged OPPalyte® TW film provided with a coating of W.R. Grace OPL-6E lacquer readily adhered to a surface such as a wall. It was found that with progressively smaller sized sheets, the force of attraction of the film to a surface becomes less effective. If the normal attractive force is overcome by frictional force of a dry erase marker on the film surface plus the force exerted by the individual doing the writing, the film may move on the adhering surface, and may or may not fall to the ground. With smaller sheets an adhesive stripe of removable pressure sensitive adhesive, as used on Dennison paper STICK ON NOTES, may be applied to the opposite side of the OPL-6E coated film, allowing the small sized sheet of film to adhere to surfaces and be imaged by dry erase markers without displacing the film. In addition, with large sheets of the coated OPPalyte® TM material an edge of removable pressure sensitive adhesive allows the reinforced stacking of one sheet on top of another as in a pad. The top sheet can subsequently be dry erase imaged, peeled back but not totally removed from underlying sheets and later dropped back in place into the neat, pad format.

OPPalyte® TW film coated with OPL-6E was cured by both UV and EB curing methods. It was found that the EB curing is prreferred because this treatment does not heat the web to the same degree as UV lamps, thus reducing the shrinkage of the polypropylene film.

The OPL-6E coated OPPalyte® TW film resisted over 1000 marks, rubs and re-marks in the same area, i.e., the surface did not degrade and resisted ink stain, even when using a marker containing methyl isobutyl ketone, one of the more aggressive solvents used in dry erase ink technology. The test was terminated at this point.

OPPalyte® TW film was coated on one or both sides to eliminate the surface deformation problem encountered when imaged by dry erase markers, yet in both instances it still retained its electrostatic cling properties. With the applied overcoating, the film will adhere to solid surfaces regardless of whether it is a coated or uncoated side that contacts the solid surface.

This invention will be further understood with reference to the following examples which are purely exemplary in nature and are not meant to be utilized to limit the scope of the invention.

EXAMPLE 1

A commercial available dry erase marker ink laden with solvent was marked on the surface of an OPPalyte ® TW film, and left resident on the sheet for varying periods of time before erasing the mark. It was found that one or more components in the film forming ink caused deformation of the OPPalyte ® TW film, i.e., the film, approximately 1.5 to 2.0 mils in thickness, expands on the marked surface and dimples outwardly in the area where the dry erase ink was marked. Thus, from an esthetic view point, this film does not provide an acceptable substrate for dry erasable marker inks. Furthermore, when being used for presentation sheets or for flip charts in which the ink surface is allowed to contact the back side of the preceding sheet, permanent deformation of the proceeding sheet results.

It was further observed that besides sheet deformation due to action by ink components, the abrasive wear due to repetitive marking and erasing of the inks from the soft OPPalyte ® TW surface caused the surface of the film to become worn and rough, thus providing peaks and valleys. The valleys subsequently mechanically trapped dry ink leaving ghost images when attempts were made to erase the ink markings.

EXAMPLE 2

OPPalyte ® TW was corona treated and then coated with W.R. Grace OPL-6E lacquer on one or both sides of the web. The coating was applied by a 110 quad gravure cylinder in the offset gravure mode. The web speed was 100 feet/min. In-line exposure to machine setting of 3 megarad dose of EB radiation cured the coating. The OPPalyte ® TW contained little or no antistat and triboelectric charging of the OPPalyte ® TW was accomplished either by rubbing or separating the film from another sheet of the film, thereby generating a voltage reading of between 5 and 10 kilovolts as measured in air with an Autostat ® electrostatic locator Model 224CL. Ever present building vibrations provide continuous triboelectric charging between the film and surface on which it is mounted. The statically charged film will cling to most surfaces for a significant period of time, days, weeks or even months, until the force of attraction between the film and the surface is exceeded by ambient external forces, e.g., gravity, air movement, human interference. The surface tension of the cured OPL-6E coating was about 43 dyne/cm at 22° C. ambient temperature, and the coating was subjected to more than 1000 marking/erase cycles within the same area without noticable deterioration of the dry erase substrate.

It was surprising to find that the image was essentially fully erased with only one stroke using a conventional felt dry wipe eraser and only normal manual effort.

EXAMPLE 3

W.R. Grace OPL-6E lacquer was applied to corona treated OPPalyte ® TW film via a No. 9 Meyer rod and then passed under a Fusion System "D" and/or "H" UV lamp at 50 feet/min. to cure. The degree of photopolymerization was tracked by monitoring the decrease in infrared absorption at 810 $cm^{-1}$ (12.35 microns). A second pass under the "D" and/or "H" lamp at 50 feet/min. yielded little further change in the 810 $cm^{-1}$ absorption band. The coated substrate survived dry erase ink marking/erase cycles in a manner similer to Example 2 and was fully erased with only one stroke as in Example 2.

EXAMPLE 4

Dennison Manufacturing Company produced removable pressure sensitive label laminate was coated with W.R. Grace OPL-6E lacquer by either offset gravure or Meyer rod methods as outlined in Example 2 or 3. The face stock employed in this laminate was 60#James River matte paper. Either UV or EV radiation was used to cure the smooth coating. A sample of EB cured OPL-6E lacquer on this removable pressure sensitive label laminate was subjected within the same area to more than 2000 repetitive marking/erase cycles over a period of weeks without noticeable deterioration of the dry erasable article. The surface tension of the coating was about 30 dyne/cm at 22° C.

EXAMPLE 5

A pressure sensitive label manufactured by Dennison comprising a polyester film face stock, printed with ink and top coated with a UV cured Voracryl epoxy acrylate lacquer (three 200 watt/inch mercury vapor lamps used as radiation source) is dry erasable on its cured epoxy acrylate surface. The 22° C. surface tension of this cured layer is about 34 dyne/cm.

EXAMPLE 6

A Dennison manufactured paper facestock pressure sensitive label, comprising a UV cured urethane/epoxy acrylate top coating of moderate friction level and somewhat molted appearance, did not image smoothly with dry erase markers. The ink failed to wet out the radiation cured coating and, on erasing, a permanent stain remained due to inadequate crosslink density. In addition, the 22° C. surface tension of the cured outer coating was only about 22 dyne/cm.

EXAMPLE 7

Dennison manufactured removable pressure sensitive label stock utilizing 60#James River matte paper as facestock was offset gravure coated with Metallized Products, Inc. EB curable urethane acrylate resin 11291-B at a web speed of 100 feet/min. This lacquer coating was exposed to a machine setting of 3 megarad dose of EB radiation. The resultant coating had a surface tension at 22° C. of about 40 dyne/cm, but exhibited moderate friction level although glossy in appearance. This article displayed only fair dry erasable marking character, with ghost images present after erasing.

EXAMPLE 8

Inmont 1016 epoxy acrylate coating exposed at 100 feet/min. to a Fusion Systems "D" and/or "H" UV lamp affored a coating with a 22° C. surface tension of about 44 dyne/cm, but possessed moderate friction level despite a glossy appearance. Although the surface imaged easily with dry erase markers, heavy ghost images remained on erasing. The coating formulation and/or the curing procedure was inadequate since apparently the resultant radiated sample possessed too low a crosslink density to resist attack by the chemical ingredients in the dry erase markers.

EXAMPLE 9

A 29# coated paper stock was top coated with the following alkyd formulation: DeSoto Alkyd 630-006 (100 parts by weight), Cycat 600 - para toluene sulfonic acid (7.6 parts by weight) and Dow Corning Surfactant 193 (10 parts by weight). The alkyd coating was cured by heating for 5 minutes at 300oF The cured coating exhibited a surface tension at 22° C. of about 22 dyne/cm and was of low friction level and high gloss. Denatured alcohol based dry erase inks wet out the surface smoothly, but ketone based inks beaded up because of an inability to wet the surface. Both types of dry erase inks, however, were easily erased.

EXAMPLE 10

Commercially available card stock with an aromatic ester/urea formaldyhyde resin coating exhibiting a 22° C. surface tension of about 36 dyne/cm, moderate friction level and matte surface appearance, was permanently stained after marking with dry erase markers and subsequent rubbing with a dry cloth. On the other hand, the heavy ghost image was substantially removed on wet erase with ethyl alcohol.

EXAMPLE 11

A sample of the OPL-6E lacquer coated OPPalyte ® TW film prepared in Example 2 was marked with a permanent marker, Dennison Carter's MARKS-A-LOT ®. Such marks could not be erased from the surface of the OPL-6E coated surface by mere rubbing with a cloth. However, overwriting the dried "permanent" mark with a dry erase marker containing ethyl alcohol as solvent, or erasing with an eraser, or other suitable material, containing ethyl alcohol, allowed subsequent prompt removal of the "permanent" mark by rubbing erasure without deformation or attack of the underlying film substrate.

What is claimed is:

1. An erasably markable article comprising a film substrate having two surfaces, wherein at least surface of the film substrate is markable with dry wipe inks without permanent discernible distortion of the film substrate, said surface after marking being substantially fully erasable by dry erasure, and said markable surface being provided by a smooth coatign of cured lacquer.

2. A method for producing an erasably markable article comprising a film substrate having two faces wherein at least one face of the film substrate is markable with dry wipe inks without permanent discernible distortion of the film substrate, the method comprising:

a. forming over at least one face of the film substrate a continuous layer of curable lacquer, and b. exposing the article to an energy source to cure the lacquer, resultign in a smooth coating of cured lacquer forming said markable surface wherein said markable surface has the property that it prevents permanent discernible distortion of the film substrate after marking with dry wipe ink and is substantially fully erasable after said marking by dry erasure.

3. The article of claim 1, wherein the substrate comprises polyester or polypropylene film.

4. The article of claim 1, wherein the substrate is a statically chargeable, biaxially oriented polypropylene multilayer film having a closed cell, foam-like core, said coated substrate having the characteristic that it has electrostatic cling properties and said cured lacquer coating prevents permanent discernible distortion of the substrate after marking the dry wip ink.

5. The article of claim 1, wherein the cured lacquer comprises a radiation cured lacquer.

6. The article of claim 9, wherein the radiation cured lacquer comprises urethane acrylate.

7. An article in accordance with claim 1, wherein the erasably markable surface is dry erasable.

8. An article in accordance with claim 1, wherein the erasably markable surface is wet erasable.

9. An article in accordance with claim 1, wherein the erasably markable surface is capable of being marked and then erased more than 1,000 times.

10. An article in accordance with claim 1, wherein the surface tension of the smooth coating of cured lacquer is greater than the surface tension of dry wipe inks, said surface tension of the coating of cured lacquer being at least 22 dynes/cm. at 22° C.

11. An article in accordance with claim 1, wherein the erasably markable article is erasably markable with dry wipe inks having a surface tension at 22° C. of between about 22 and 30 dyne/cm, and the surface tension of said cured lacquer coating is greater than the surface tension of the ink.

12. A method in accordance with claim 2, wherein prior to step (a), the one surface is corona treated.

13. A method in accordance with claim 2, wherein lacquer is cured by exposing a heat.

14. A method in accordance with claim 2, wherein lacquer is cured by exposing the electron beam and/or ultraviolet radiation.

15. A method in accordance with claim 2, wherein the substrate is a polyester or polypropylene film.

16. A method in accordance with claim 2, wherein the substrate is a statically chargeable, biaxially oriented polypropylene multilayer film having a closed cell, foam-like core, said coated substrate having the characteristic that it has electrostatic cling properties.

17. A method in accordance with claim 2, wherein the cured lacquer comprises radiation cured lacquer.

18. A method in accordance with claim 2, wherein the lacquer comprises urethane acrylate.

19. An erasably markable article comprising a substrate comprised of a sheet of material elected from the group comprising of paper and cardboard, wherein at least one face of the substrate is markable with dry wip inks, said face after marking being substantially fully erasable by dry erasure, and said markable surface being provided by a smooth coating of cured lacquer, which smooth coating does not substantially impregnate the substrate.

20. An article in accordance with claim 19, wherein the substrate is paper.

21. An article in accordance with claim 19, wherein the substrate is cardboard.

22. An article in accordance with claim 19, wherein the cured lacquer comprises a radiation cured lacquer.

23. An article in accordance with claim 19, wherein the radiation cured lacquer comprises urethane acrylate.

24. An article in accordance with claim 19, wherein the erasably markable surface is wet erasable.

25. An article in accordance with claim 19, wherein the erasably markable surface is capable of being marked and then erased more than 2,000 times.

26. An article in accordance with claim 19 wherein the surface tension of the smooth coating of cured lacquer is greater than the surface tension of dry wipe inks, said surface tension of the coating is cured lacquer being at least 22 dynes/cm. at 22° C.

* * * * *